US008484866B2

(12) United States Patent
Fluharty et al.

(10) Patent No.: US 8,484,866 B2
(45) Date of Patent: Jul. 16, 2013

(54) DIG UNDER APPARATUS AND PROCESS

(75) Inventors: John Walter Fluharty, Naples, FL (US); Jay Wendell Fluharty, Sugar Loaf Key, FL (US); Karl D. Quackenbush, Blanchard, MI (US); Richard A. Hahn, Mt. Pleasant, MI (US)

(73) Assignee: Quanta Associates, L.P., Houston, TX (US)

( * ) Notice: Subject to any disclaimer, the term of this patent is extended or adjusted under 35 U.S.C. 154(b) by 324 days.

(21) Appl. No.: 12/903,192

(22) Filed: Oct. 12, 2010

(65) Prior Publication Data

US 2011/0088291 A1 Apr. 21, 2011

Related U.S. Application Data

(60) Provisional application No. 61/250,328, filed on Oct. 9, 2009.

(51) Int. Cl.
*E02F 3/08* (2006.01)

(52) U.S. Cl.
USPC ..... 37/352

(58) Field of Classification Search
USPC ..... 37/94, 189, 190, 462, 465, 347, 91, 37/92, 403–411, 352–355; 405/159, 161, 405/180, 181, 267
See application file for complete search history.

(56) References Cited

U.S. PATENT DOCUMENTS

| | | | | |
|---|---|---|---|---|
| 3,266,179 | A * | 8/1966 | Golden | 37/355 |
| 5,212,892 | A | 5/1993 | Maitlen et al. | |
| 5,795,101 | A * | 8/1998 | Bill | 405/184.5 |
| 5,813,151 | A * | 9/1998 | Stephens et al. | 37/352 |
| 6,349,488 | B1 * | 2/2002 | Mason | 37/94 |
| 2002/0116844 | A1 | 8/2002 | Collins et al. | |
| 2006/0230646 | A1 | 10/2006 | Schmidt et al. | |
| 2007/0183847 | A1 | 8/2007 | Gordon et al. | |

FOREIGN PATENT DOCUMENTS

WO 00-06835 2/2000

OTHER PUBLICATIONS

Cho, Durk Hyun, International Search Report & The Written Opinion, Jun. 28, 2011, 10 pages, Korean Intellectual Property Office, Republic of Korea.

* cited by examiner

*Primary Examiner* — Robert Pezzuto
(74) *Attorney, Agent, or Firm* — Mark A. Oathout; Oathout Law Firm

(57) ABSTRACT

A soil removal apparatus in one embodiment has a motive power unit and an excavator joined to the motive power unit by a coupler, the excavator extending laterally of the motive power unit. The coupler includes a manipulator for manipulating the excavator to loosen and displace soil material in a path lateral to a path of movement of the motive power unit. The method relates to undercutting an object with a motive power unit, selectively halting and moving the motive power unit, and loosening and displacing soil lateral to the path of travel of the motive power unit.

23 Claims, 6 Drawing Sheets

DIG UNDER APPARATUS AND PROCESS

CROSS-REFERENCE TO RELATED APPLICATIONS

This application claims the benefit of U.S. Provisional Application No. 61/250,328, filed Oct. 9, 2009.

BACKGROUND

Large pipe maintenance requires a significant amount of soils to be excavated not only from the top circumference of the pipe, but also from the lower circumference of the pipe. For purposes of this application the term "soil" or "soils" shall mean any of a variety of formations that may be around a pipe or other structure buried at any depth below a surface including, but not limited to, the more traditional soil, rock and/or limestone. These soils that are found beneath the pipe are not likely to have been excavated during the installation of the pipe line. The soils are highly compacted in this area and are labor intensive to excavate. But typically, these soils must be removed to allow proper clearance for all major maintenance procedures.

Strict excavating procedures have been implemented by most gas pipeline controllers, resulting in a twenty-four inch (60.96 cm.) zone or area around the circumference of the pipe that no machine is allowed, this procedure creates a labor intensive dig procedure, for exposing the pipe.

SUMMARY

In one aspect, the embodiments disclosed herein relate to an apparatus and method for undercutting an object by excavating soil material beneath the object.

In one embodiment, the apparatus for removing soil material has a motive power unit movable along a ground surface. An excavator is joined to the motive power unit by a coupler, and the excavator extends laterally of the motive power unit. The coupler includes a manipulator for manipulating the excavator to loosen and displace soil material in a path lateral to a path of movement of the motive power unit along the ground surface. As used in this application, the term "lateral" or "laterally" means to the side, flank or askant whilst the cutting blade or surface need not necessarily be positioned longitudinally at a right angle from a direction of travel, but rather the cutting blade or surface could be manipulated or positioned transversely. Furthermore, "lateral" or "laterally" is not limited to a horizontal plane but rather encompasses an approximate conical arc above and/or below the horizontal as manipulated ("manipulation" to be further described below). In another embodiment, the apparatus includes a motive power unit and an excavator coupled to motive power unit. The excavator is capable of rotating within a plane parallel to the ground supporting the motive power unit.

One embodiment of the method positions a motive power unit having an excavator in a trench adjacent to the object and excavating beneath the object with the excavator.

DETAILED DESCRIPTION OF THE EMBODIMENT(S)

Figure 1:
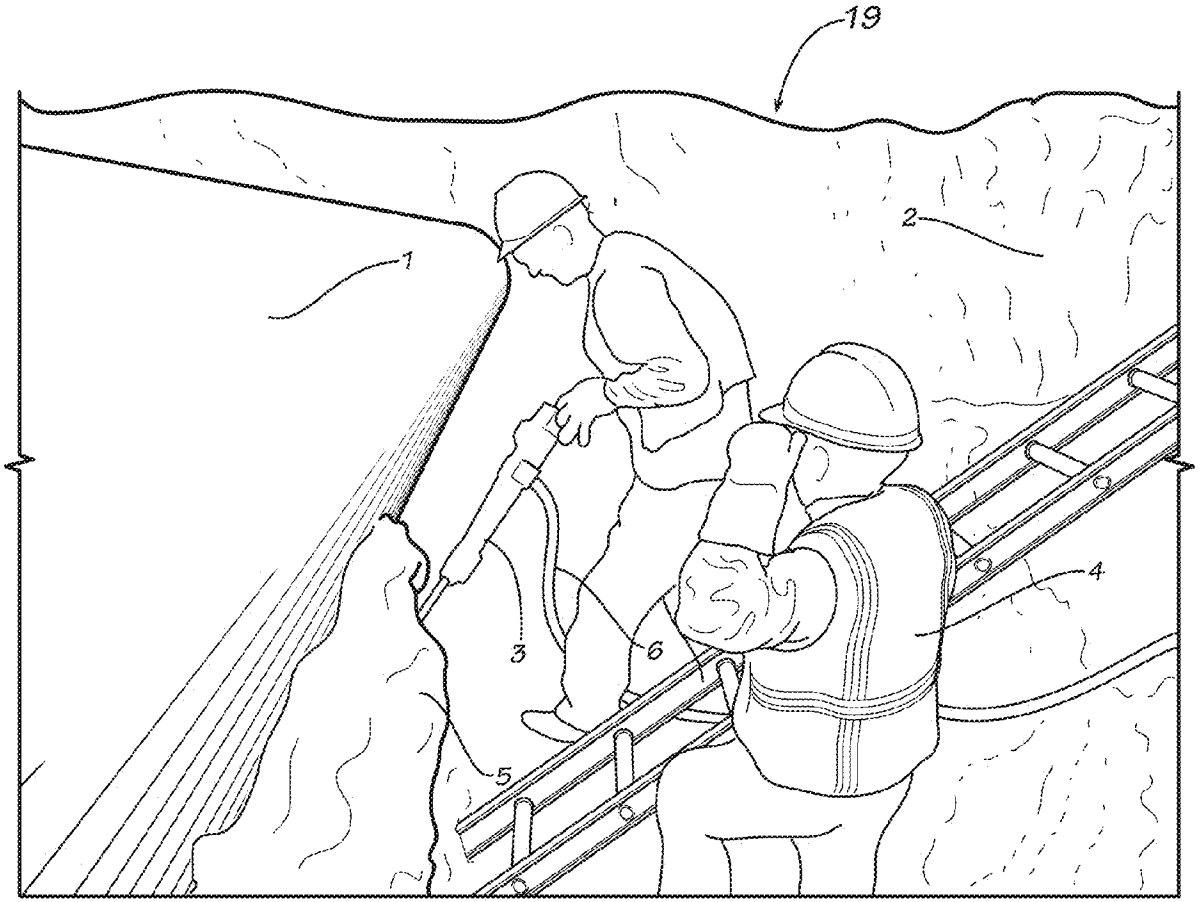
FIG. 1 is a perspective view of laborers in a ditch excavating undisturbed soils from a large diameter pipe line requiring maintenance.

With reference to FIG. 1, a prior art method of undercutting a pipe is demonstrated. A large pipe 1 is being exposed by laborers 4 in a ditch. The depths of the pipe typically vary from thirty-six inch of soil cover over the top of pipe 1 to sixty inches of cover. In most cases, but not limited to, pipe 1 is constructed of steel. The diameter of buried pipe 1 may vary in size, but most large diameter pipe will range in sizes twenty inches through forty-two inches diameter.

When long sections of buried pipe 1 are unearthed for maintenance reasons, the digs will run several thousands of feet in length. Air operated tools 3 are commonly used to excavate the hardened soils 5 from under the pipe 1 inside the ditch.

Once the soils 5 have been loosened and moved from under the pipe 1, they are then moved with a backhoe or the like to the top of the bank 2 where they are stored until the replacement of the spoils is implemented using soil from spoil bank 2.

Figure 2:
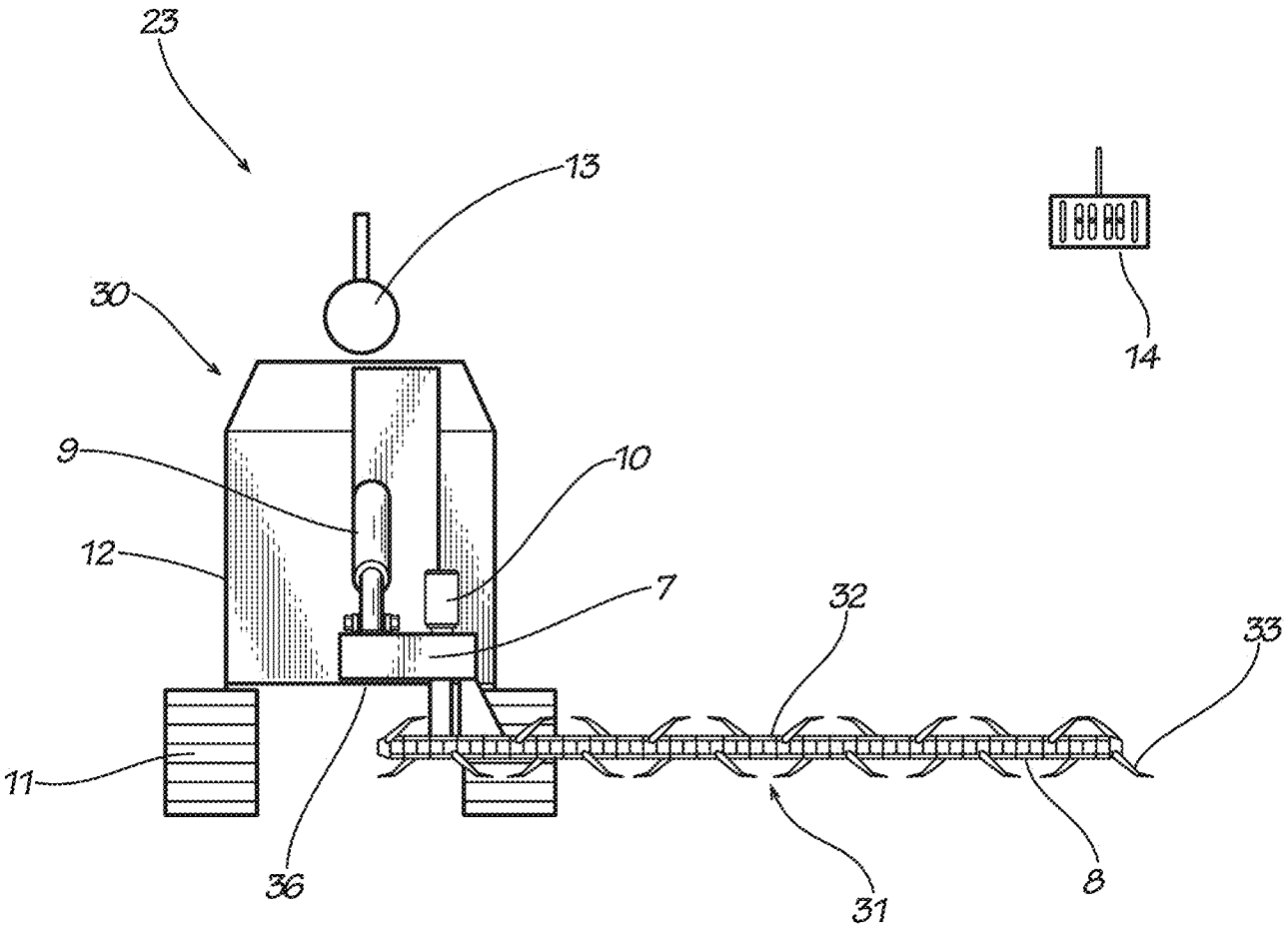
FIG. 2 is an elevation view of one embodiment of the apparatus for removing soil material showing machine related components.

In one aspect, the embodiments of the apparatus disclosed herein relate to a device for removing soil material beneath (i.e. undercutting) an object 23, such as a pipe 1. Referring to FIG. 2, an embodiment of a soil removing device is shown. The device generally includes a motive power unit 30 and an excavator 31 mechanically joined to the motive power unit 30 by a coupler (represented in this embodiment as a trenching attachment mount) 7. The excavator 31 extends laterally of the motive power unit. to excavate soil in a path that is lateral to the path of movement of motive power unit 30. In some embodiments, the excavator 31 is configured so that it is capable of rotating within a plane that is substantially parallel to the ground supporting the motive power unit 30, referred to herein as horizontal. Optionally, the excavator 31 may be capable of full 360° rotation.

The motive power unit 30 includes a power plant 12. In some embodiments, the power plant 12 generates hydraulic pressure that may be used as the source of power to propel motive power unit 30. The power plant 12 may use a muffler 13 to condition exhaust noise levels during operations. In one embodiment, wheels and/or tracks 11 are operatively connected to the power plant 12 to support the power plant 12 and propel the motive power unit 30. The power plant 12 propels the wheels and/or tracks 11 via any means known in the art. In some embodiments, drive belts or gears may be used. Optionally, one or more hydraulic motors may be connected to the power plant to produce the mechanical energy necessary to propel the tracks or wheels.

The excavator 31 may be configured so that as the motive power unit 30 moves in a path, the excavator removes soil material situated in a lateral path. In one embodiment, the excavator 31 includes an elongated support member 32 that is coupled to the motive power unit 30. The elongated support member 32 extends or is manipulatable to extend outwardly or transversely to one side or laterally of the motive power unit 30. For example, the support member 32 may extend laterally about sixty inches (152.4 cm.) from the motive power unit 30. In some embodiments, the support member 32 may include a plurality of support squares 26. The support squares 26 strengthen the support member 32, allowing it to better resist the forces exerted during the excavation process. For example, the support member 32 must withstand violent shaking that may occur when the excavator encounters hardened soil or rock.

Moreover support member 32 may be configured with a guard surface 27 (see FIG. 5) extending outwardly and projecting above a plurality of teeth 33 attached to a chain 8 (i.e. projecting above the excavator 31), such that chain 8 and/or teeth 33 will not interfere with the pipe 1 (i.e. damaging interference is prevented).

Figure 3:
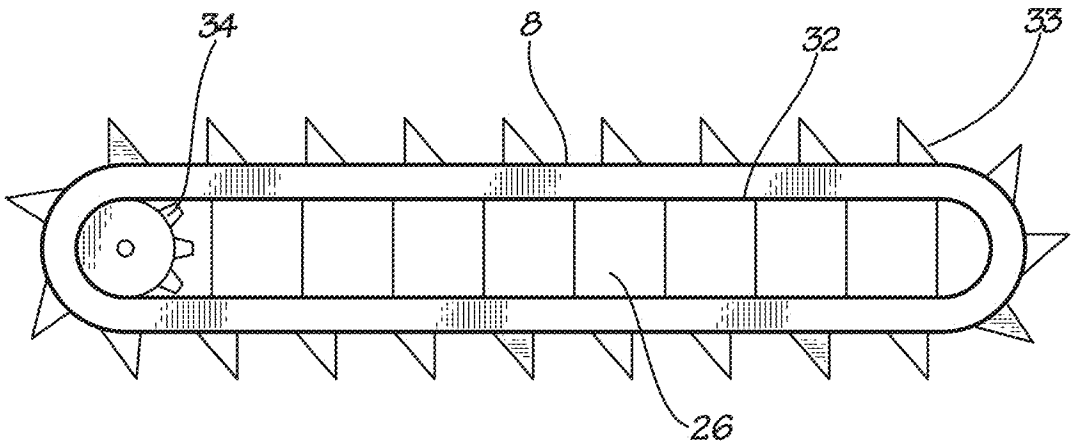
FIG. 3 is an overhead view of one embodiment of the excavator.

The chain 8 is configured to rotate about the support member 32. The plurality of teeth 33 are attached to the chain 8. The chain 8 may be a commercially available trencher chain. For example, suitable trencher chains are commercially available from ASTEC Industries Inc. of Loudon, Tenn. In one embodiment, the support member 32 includes a gear 34 (FIG. 3) that engages with the chain 8 to rotate it around the sides of the support member 32. The power plant 12 hydraulically powers a hydraulic motor 10 to produce the rotational motion that operates the gear 34 and in turn rotates the chain 8. In operation, the soil material is sawed and moved to one side or the other from beneath the pipe or other object with the chain 8.

Figure 4:
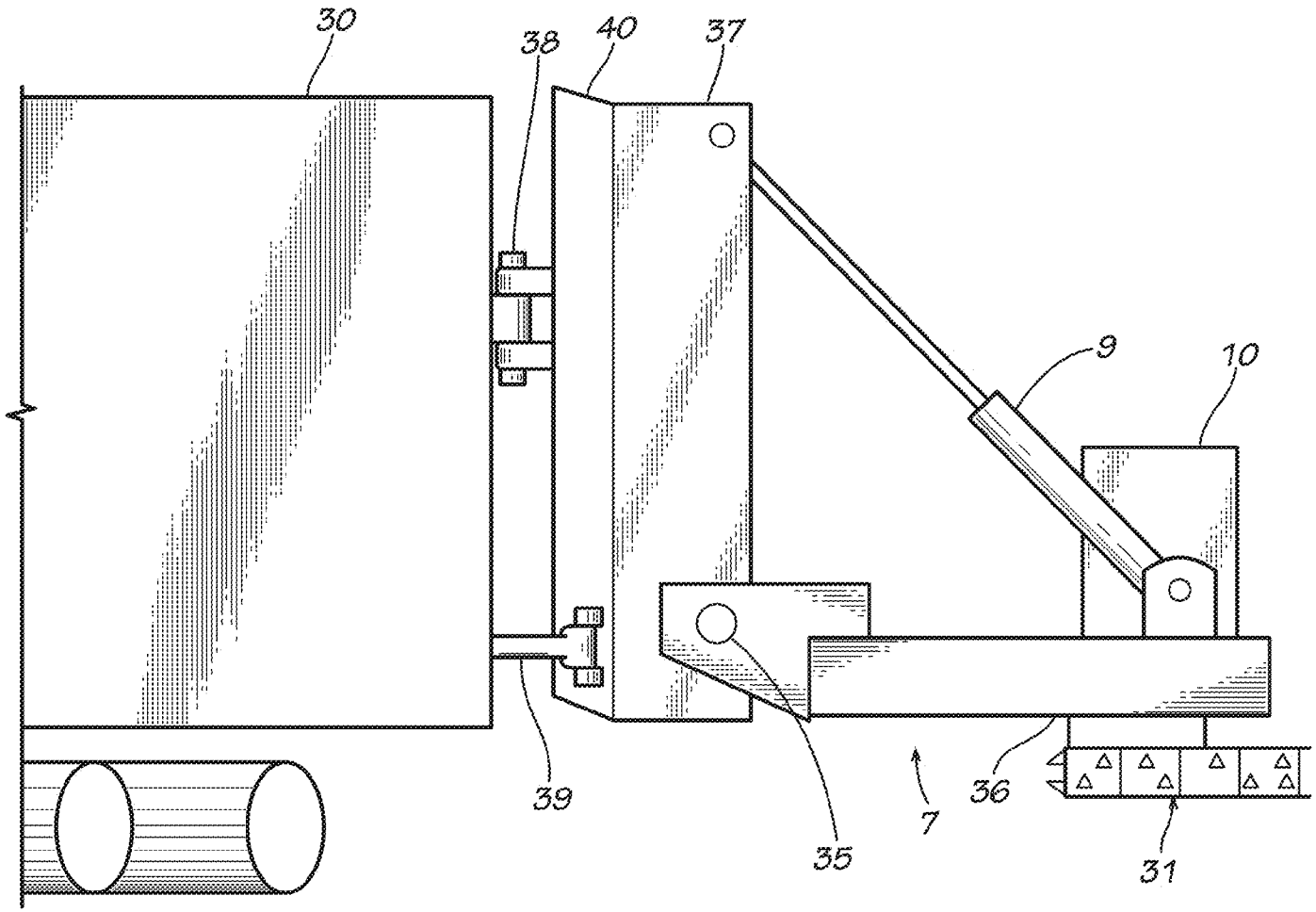
FIG. 4 is a side view of one embodiment of the apparatus for removing soil material.

The excavator 31 may be coupled to the motive power unit 30 by a trenching attachment mount type coupler 7. The mount 7 is hingeably attached to the motive power unit 30 and attached to the excavator 31. Referring to FIG. 4, in one embodiment, the mount 7 comprises a pivot pin 35 and a lift cylinder 9. The pivot pin 35 connects the mount 7 to the motive power unit 30 at one location. The manipulator (represented in the embodiment shown as a lift cylinder) 9 is attached to to the motive power unit 30 at one end and the mount 7 at the other end. The lift cylinder 9 is operable to rotate the mount 7 in a vertical direction about the pivot pin 35. This adjusts the attitude of the excavator 31. The attitude is adjustable, by way of example only, through a range of about seven degrees below the horizontal to about eleven degrees above the horizontal. In some embodiments, the lift cylinder 9 may be a hydraulic cylinder receiving hydraulic pressure from the power plant 12.

The mount 7 may be attached to the motive power unit 30 so that the support member 32 is able to swing from its side position to a straight-forward position ahead of the motive power unit 30. The advantage of this configuration is that it more easily allows the motive power unit 30 to be entered or exited from a tight space, such as a trench, before engaging the excavator 31. The motive power unit 30 may further include another coupler (represented in the embodiment shown as a brace) 37 to which the mount 7 is attached. The brace type coupler 37 may be hingeably attached (via hinge and pin arrangement 38) to one end (preferably the front-end but could alternatively be the back-end, top-side end, bottom-side end, etc.) of the motive power unit 30 to allow the brace 37 to move within a substantially horizontal plane. The motive power unit 30 may further include another manipulator (represented in the embodiment shown as an extendable rod) 39 attached to brace 37. The extension of the rod type manipulator 39 may be hydraulically actuated by the power plant 12. The motive power unit 30 may extend or retract the rod 39 to change the relatively horizontal angle of the brace 37 to motive power unit 30. Changing the position of the brace 37 will in turn move the mount 7 and the attached excavator 31. Thus, the excavator may be moved to extend transversely or outwardly from the side of the motive power unit 30. The brace 37 may further include an angled section 40 that increases the maximum outward angle to which the excavator may be moved. The relatively horizontal angle is adjustable, by way of example in the embodiment shown, through a range of about ninety degrees (with zero degrees meaning the excavator 31 or other attachment is longitudinally aligned with the direction of travel, yet transversely adjustable, with ninety degrees meaning the longitudinal axis of the excavator 31 is perpendicular to a direction of travel of the motive power unit 30.

The trenching mount attachment 7 may further include the hydraulic motor 10 and a transmission 36. The transmission 36 transfers the mechanical energy produced by the hydraulic motor 10 to the excavator 31. The transmission 36 may include at least one gear and may be enclosed in a protective housing.

Figure 5:
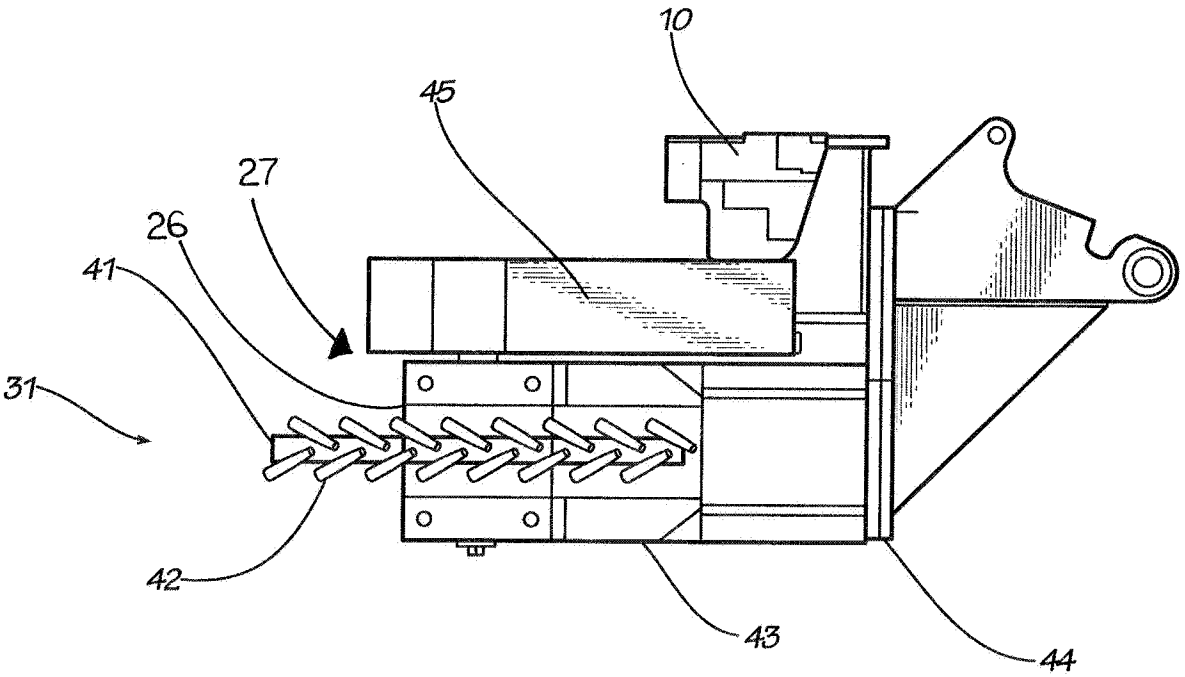
FIG. 5 is an elevation view of one embodiment of the excavator.

Referring to FIG. 5, in another embodiment, the excavator 31 comprises a cutting wheel 41. The cutting wheel 41 has a cutting surface 42 that may be formed of plurality of cutting teeth or an abrasive surface. The cutting wheel 41 is coupled to a support 43 which positions the cutting wheel 41 while allowing it to rotate and may be manipulated as the excavator 31 is manipulated. The support 43 connects the cutting wheel 41 to the motive power unit 30. The support 43 may further include a rotatable flange type coupler 44 that allows the cutting wheel 41 to be rotated between a substantially horizontal position and a substantially vertical position. In this configuration, the cutting wheel 41 may selectively make horizontal or vertical cuts as needed. The support 43 may further include the hydraulic motor 10 providing the mechanical energy to rotate the cutting wheel 41 via an enclosed transmission or drive belt 45. In addition, support 43 and/or guard surface 27 may extend laterally and project above cutting wheel 41 preventing or inhibiting damaging interference between the cutting surface 42 and the pipe 1. Advantageously, the cutting wheel may be capable of slicing through rock, concrete, metal or other hardened, solidified materials.

Referring to FIG. 2, some embodiments of the soil removal device may include a remote control system. Remotely operating the soil removal device increases its safety by allowing the human operator to remain at a safe distance from the motive power unit 30 and the excavator 31. The remote control system may comprise a remote 14, which is able to communicate with the motive power unit 30 to control many of the functions of the soil removal device. This communication may be performed either wirelessly or though a communication cable. The remote control system may include a wireless antenna accompanied by a receiver and a cam bus, which translate the radio signal from the remote 14 into electronic outputs that can be programmed with a variety of parameters (e.g. hydraulic pressures to the various parts of the soil removal device). For example, the hydraulic pressure to the wheels and/or tracks 11, the hydraulic motor 10, lift cylinder 9, and/or the rod 39 may be controlled by the remote 14. Thus, the remote control system may be configured to allow the operator to control the movement of the motive power unit 30, the speed of the hydraulic motor 10 that in turn controls the rotational speed of the excavator 31, the vertical angle of the mount 7, and/or the horizontal position of the excavator 31.

In one aspect, the embodiments of methods disclosed herein relate to removing soil material beneath an object, such as a pipe 1. This process is herein referred to as undercutting.

In another aspect, some embodiments of the methods disclosed herein relate to undercutting with a mechanical apparatus.

One embodiment of the method of undercutting an object comprises positioning a motive power unit 30 comprising an excavator 31 in a ditch or trench 19 (see FIG. 6) adjacent to the object and excavating beneath the object with the excavator 31. The method may further comprise moving the motive power unit 30 along the length of the ditch or trench 19 while excavating beneath the object with the excavator 31. As the motive power unit moves in a forward direction alongside the object, the excavator 31 removes soil material under the object in a parallel path to the direction movement. This process may be particularly advantageous for undercutting elongated objects such as a pipe.

In some embodiment(s), the soil material beneath the object may be excavated by rotating a chain 8 comprising teeth to saw the soil material. Alternatively, the soil material may be removed by rotating a cutting wheel 41 beneath the object. Sawing the soil material with the cutting wheel 41 may be particularly advantageous when rocks or other hard materials are encountered in the soil material. The method may further include undercutting the object by rotating the excavator 31 within a substantially horizontal plane. Some embodiments of the method may further include operating the motive power unit 30 with a remote control. This may include driving the motive power unit 30, starting and stopping the rotation of the excavator 31, and/or selecting the attitude or position of the excavator 31.

Figure 6:
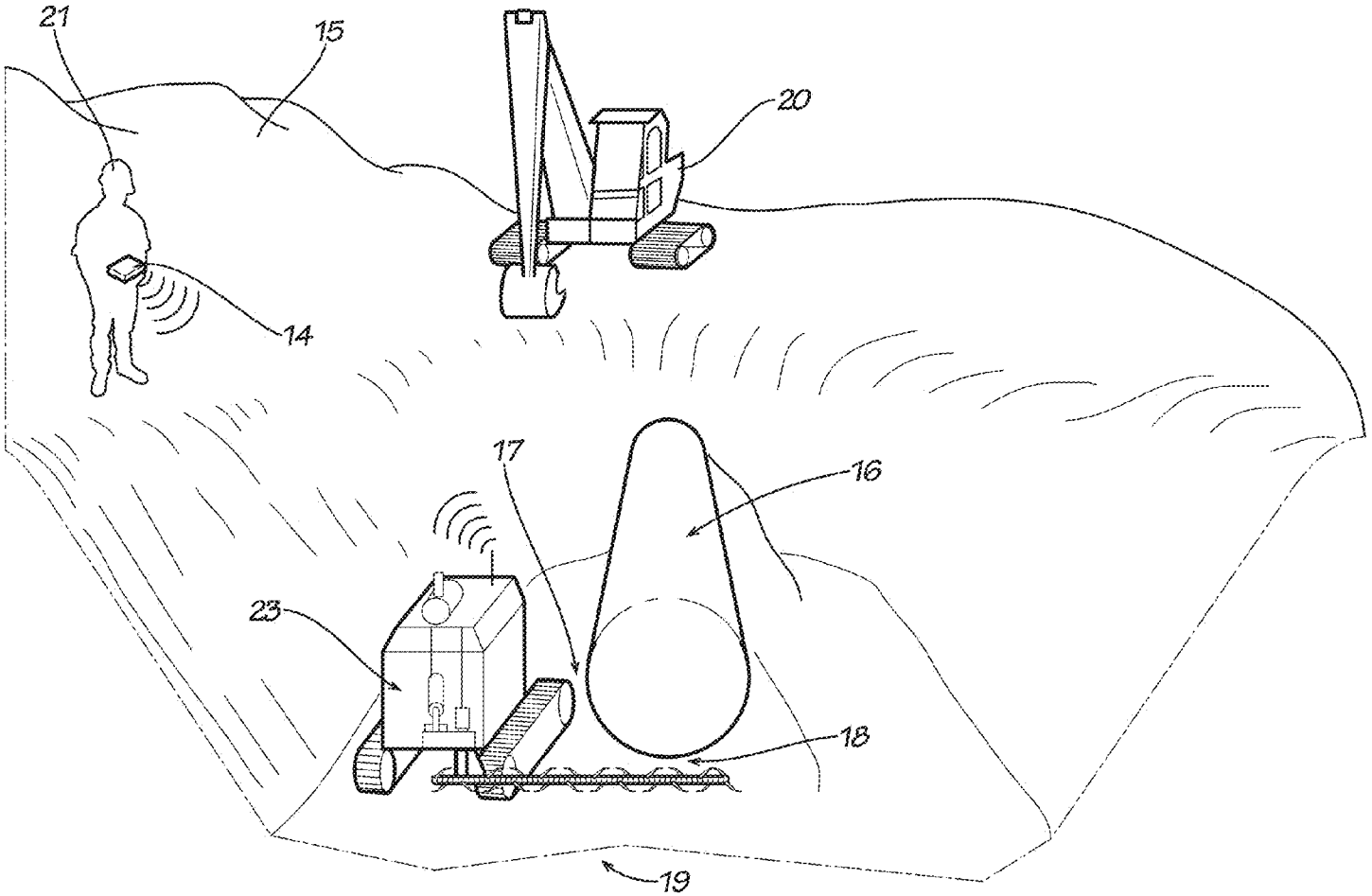
FIG. 6 is a perspective view showing the profile of the dig under machine in relation to the pipe in an excavated ditch removing soils from the region of the pipe.

Using FIG. 6 as reference the following will describe how one embodiment of the digging process is performed using a dig under machine 23. The backhoe (or the like) 20 opens and exposes twenty feet (6.1 meters) of pipe 16 with a navigable ramp allowing for safe access for the dig under machine 23 (a.k.a. device for removing soil material beneath an object) to enter and selectively move across the ground surface of the ditch 19. The operator 21 is positioned safely above the ground surface of the ditch 19 where he or she will use the remote 14 to navigate the dig under machine 23 into position (the dig under machine 23 would normally be cutting toward the viewer of FIG. 6 as opposed to away, and pipe 16 is cut-away or sectioned at the end in the drawing so the dig under machine 23 can be viewed in greater detail). When the required clearance of, for example, twenty-four inches (60.96 cm) has been determined at locations 17 and 18, the operator 21 will then start the soil removal process from beneath (i.e. undercutting) the pipe 16 using the dig under machine 23 to loosen and displace soil out from under the pipe 16. The operator also halts and advances (or reverses) the travel path of the dig under machine 23 to work the soil as needed. While the dig under machine 23 loosens and displaces the soils from beneath the pipe 16, the backhoe 20 lifts the soils to the spoil pile 15. The dig under machine 23 can be used with any buried horizontal structure. It is not limited to use with a buried pipe 16.

What is claimed is:

1. An apparatus for removing soil material comprising:

a motive power unit movable along a ground surface;

an excavator including an elongated support member coupled to the motive power unit by a coupler, the elongated support member extending laterally of the motive power unit;

wherein the excavator is configured for excavating laterally beneath an object whilst the motive power unit is moving in a path across the ground surface;

wherein the coupler includes a manipulator for manipulating the excavator to loosen and displace soil material in a path lateral to a path of movement of the motive power unit along the ground surface; and a remote configured to communicate remotely from and with the motive power unit for controlling the motive power unit, the excavator and the manipulator.

2. The apparatus according to claim 1 wherein the motive power unit comprises:

a power plant; and a pair of drive tracks supporting the power plant.

3. The apparatus according to claim 1 wherein the excavator comprises:

the elongated support member;

a chain configured to rotate about the elongated support member; and a plurality of teeth attached to the chain.

4. The apparatus according to claim 1, wherein the elongated support member further comprises a guard surface mounted in the elongated support member, wherein said guard surface is configured to project above the excavator.

5. The apparatus according to claim 1 wherein the excavator comprises:

a cutting wheel support; and a rotatable cutting wheel coupled to the cutting wheel support.

6. The apparatus according to claim 5 wherein the cutting wheel support comprises a rotatable flange for rotating a cutting angle of the cutting wheel.

7. The apparatus according to claim 1 wherein the coupler comprises a mount that is attached to the motive power unit and attached to the excavator; and wherein the manipulator further comprises a lift cylinder having a first end attached to the motive power unit and a second end attached to the mount, wherein the lift cylinder is configured to rotate the mount in a vertical direction to adjust an attitude of the excavator.

8. The apparatus according to claim 3, wherein the elongated support member further comprises a guard surface mounted in the elongated support member, wherein said guard surface is configured to project above the plurality of teeth attached to the chain.

9. The apparatus according to claim 7, further comprising another coupler, wherein the other coupler comprises a brace and the mount is hingeably attached to the brace, the brace having a horizontal hinge allowing movement of the brace and the mount in a substantially horizontal direction.

10. The apparatus according to claim 9, further comprising another manipulator, wherein the other manipulator comprises an extendable rod attached to the brace.

11. The apparatus according to claim 1, wherein the coupler comprises a brace and a mount is hingeably attached to the brace, the brace having a horizontal hinge allowing movement of the brace and the mount in a substantially horizontal direction.

12. The apparatus according to claim 11, wherein the manipulator comprises an extendable rod attached to the brace.

13. The apparatus according to claim 1 further comprising a hydraulic motor operatively connected to the excavator to power rotation of the excavator, wherein the motive power unit is the hydraulic power source of the hydraulic motor.

14. The apparatus according to claim 1 wherein the remote comprises a receiver electrically connected to a cam bus, wherein the cam bus controls a hydraulic pressure to a multiple of operations including operations selected from the group consisting of a hydraulic motor operation, and a lift cylinder operation.

15. The apparatus according to claim 1, wherein the object is a pipe to be maintained;

wherein the ground surface has a trench adjacent to the pipe;

wherein the trench is at a depth substantially defined by a horizontal plane located approximate a required clearance beneath the pipe; and wherein the motive power unit is on the ground surface of the trench.

16. The apparatus according to claim 7 wherein the lift cylinder is configured to rotate the mount in the vertical direction to the attitude not greater than about eleven degrees above the horizontal.

17. The apparatus according to claim 16 wherein the ground surface has a trench adjacent to the pipe;

wherein the trench is at a depth substantially defined by a horizontal plane located at a required clearance beneath the pipe;

wherein the required clearance beneath the pipe is at least about twenty-four inches;

wherein the lift cylinder is configured to rotate the mount in the vertical direction to the attitude within a range of from about seven degrees below the horizontal to about eleven degrees above the horizontal; and wherein the elongated support member extends laterally at least about sixty inches from the motive power unit.

18. An apparatus for removing soil material comprising:

a motive power unit movable along a ground surface, wherein the motive power unit comprises a power plant, and a pair of drive tracks supporting the power plant;

an excavator including an elongated support member coupled to the motive power unit by a coupler, the elongated support member extending laterally of the motive power unit, wherein the excavator is attached to a front-end of the motive power unit;

wherein the excavator is configured for excavating laterally beneath a pipe to be maintained whilst the motive power unit is moving in a path across the ground surface;

wherein the coupler includes a manipulator for manipulating the excavator to loosen and displace soil material in a path lateral to a path of movement of the motive power unit along the ground surface;

wherein the coupler comprises a mount that is attached to the motive power unit and attached to the excavator;

wherein the manipulator comprises a pivot pin connecting the mount to the motive power unit at one location and a lift cylinder having a first end attached to the motive power unit and a second end attached to the mount, wherein the lift cylinder is configured to rotate the mount in a vertical direction to adjust an attitude of the excavator;

another coupler, wherein the other coupler comprises a brace and the mount is hingeably attached to the brace, the brace having a horizontal hinge allowing movement of the brace and the mount in a substantially horizontal direction;

another manipulator, wherein the other manipulator comprises an extendable rod attached to the brace;

a hydraulic motor operatively connected to the excavator to power rotation of the excavator, wherein the motive power unit is the hydraulic power source of the hydraulic motor;

a remote configured to communicate remotely from and with the motive power unit or controlling the motive power unit, the excavator and the manipulator;

wherein the ground surface has a trench adjacent to the pipe;

wherein the trench is at a depth substantially defined by a horizontal plane located approximate a required clearance beneath the pipe; and wherein the motive power unit is on the ground surface of the trench.

19. A method of undercutting a pipe for removing a volume of soil comprising:

digging a trench adjacent the pipe to a depth substantially defined by a horizontal plane located approximate a required clearance beneath the pipe, wherein the pipe is to be maintained;

positioning a motive power unit in the trench adjacent to the pipe;

selectively halting and moving the motive power unit along a ground surface of the trench;

selectively loosening and displacing the volume of soil from a selected clearance from beneath the pipe performed while said step of selectively halting and moving the motive power unit along the ground surface of the trench is performed;

wherein said step of selectively loosening and displacing the soil further comprises loosening and displacing the soil in a path lateral to the trench; and remotely operating the motive power unit for said steps of selectively halting and moving the motive power unit, and selectively loosening and displacing the volume of soil.

20. The method according to claim 19, wherein said step of selectively loosening and displacing the soil further comprises manipulating an excavator by remote operation.

21. The method according to claim 20, wherein said step of manipulating the excavator further comprises manipulating in a horizontal direction.

22. The method according to claim 21, wherein said step of manipulating the excavator further comprises manipulating in a vertical direction to an attitude within a range of from about seven degrees below the horizontal to about eleven degrees above the horizontal.

23. The method according to claim 19, further comprising the step of preventing damaging interference with the pipe by guarding the pipe from a plurality of teeth attached to a chain performed during the step of selectively loosening and displacing the soil.

* * * * *